US010941657B2

(12) United States Patent
Ma et al.

(10) Patent No.: US 10,941,657 B2
(45) Date of Patent: Mar. 9, 2021

(54) CORROSION RESISTANT YIELDABLE BOLT

(71) Applicant: FCI Holdings Delaware, Inc., Wilmington, DE (US)

(72) Inventors: Lumin Ma, Pittsburgh, PA (US); Dakota Faulkner, New Kensington, PA (US); John C. Stankus, Canonsburg, PA (US)

(73) Assignee: FCI Holdings Delaware, Inc., Wilmington, DE (US)

( * ) Notice: Subject to any disclaimer, the term of this patent is extended or adjusted under 35 U.S.C. 154(b) by 59 days.

(21) Appl. No.: 15/645,312

(22) Filed: Jul. 10, 2017

(65) Prior Publication Data

US 2018/0016900 A1 Jan. 18, 2018

Related U.S. Application Data

(60) Provisional application No. 62/361,241, filed on Jul. 12, 2016.

(51) Int. Cl.

| | |
|---|---|
| ***E21D 21/00*** | (2006.01) |
| ***E21D 20/02*** | (2006.01) |
| ***E21D 20/00*** | (2006.01) |
| ***C21D 1/26*** | (2006.01) |
| ***C21D 9/00*** | (2006.01) |

(52) U.S. Cl.

CPC ..... *E21D 21/0026* (2013.01); *C21D 1/26* (2013.01); *C21D 9/0093* (2013.01); *E21D 20/026* (2013.01); *E21D 21/0006* (2013.01); *E21D 21/0046* (2013.01); *C21D 2221/01* (2013.01)

(58) Field of Classification Search

CPC . E21D 21/00; E21D 21/0006; E21D 21/0026; E21D 21/0046; E21D 21/0033

USPC ..... 405/259.1–259.6; 52/155, 698; 411/82–82.3

See application file for complete search history.

(56) References Cited

U.S. PATENT DOCUMENTS

| | | | | |
|---|---|---|---|---|
| 3,940,941 A | | 3/1976 | Libert et al. | |
| 3,942,329 A | * | 3/1976 | Babcock | E21D 21/0006 405/259.5 |
| 4,531,861 A | * | 7/1985 | Kash | F16B 13/143 405/259.1 |
| 4,589,803 A | * | 5/1986 | Totten, III | E21D 20/003 299/11 |
| 4,664,555 A | * | 5/1987 | Herbst | E21D 21/006 405/259.5 |

(Continued)

FOREIGN PATENT DOCUMENTS

| | | | | |
|---|---|---|---|---|
| AU | 2003262348 A1 | * | 6/2004 | E21D 21/0033 |
| AU | 2008221612 A1 | | 4/2009 | |

(Continued)

*Primary Examiner* — Benjamin F Fiorello
*Assistant Examiner* — Stacy N Lawson
(74) *Attorney, Agent, or Firm* — The Webb Law Firm

(57) ABSTRACT

A mine bolt includes an elongated body having a first end and a second end positioned opposite the first end, with the elongated body having a first threaded section, a second threaded section, and a non-threaded section positioned between the first threaded section and the second threaded section. The non-threaded section is configured to yield under loading when the mine bolt is installed with grout in a bore hole.

9 Claims, 5 Drawing Sheets

(56) References Cited

U.S. PATENT DOCUMENTS 5,791,823 A * 8/1998 Blakley ..... E21D 21/0026 405/259.1
6,033,153 A * 3/2000 Fergusson ..... E21D 20/026 405/259.6
6,247,883 B1 * 6/2001 Monserratt ..... F16B 13/045 411/34
8,721,227 B2 5/2014 Oldsen et al.
9,677,399 B2 6/2017 Modlinski et al.
2002/0067973 A1 * 6/2002 Shinjo ..... F16B 13/0816 411/45
2008/0038068 A1 * 2/2008 Craig ..... E21D 21/0046 405/259.3
2010/0021245 A1 * 1/2010 Li ..... E21D 21/008 405/259.5
2010/0202838 A1 * 8/2010 Weaver ..... E21D 21/0026 405/259.1
2011/0135402 A1 6/2011 Leppanen
2012/0070234 A1 3/2012 Craig
2013/0028667 A1 * 1/2013 Champaigne ..... E21D 21/004 405/259.5
2014/0047699 A1 * 2/2014 Pratt ..... F16B 19/1063 29/525.06
2016/0168993 A1 6/2016 Modlinski et al.
2016/0169260 A1 * 6/2016 Pratt ..... F16B 19/1063 411/38
2016/0326873 A1 * 11/2016 Skogseth ..... E21D 21/008

FOREIGN PATENT DOCUMENTS

CA 2917978 A1 1/2015
CN 101720379 A 6/2010
DE 3504543 C1 5/1986
WO 2011087948 A1 7/2011
WO 2011149420 A1 12/2011
WO WO-2018127294 A1 * 7/2018 ..... E21D 21/0046

* cited by examiner

CORROSION RESISTANT YIELDABLE BOLT

CROSS REFERENCE TO RELATED APPLICATIONS

This application claims the benefit of U.S. Provisional Patent Application No. 62/361,241, filed Jul. 12, 2016, the entire content of which is hereby incorporated by reference.

BACKGROUND OF THE INVENTION

Field of the Invention

This invention is related to a mine roof bolt and, more particularly, to a yieldable mine roof bolt.

Description of Related Art

The roof/ribs of a mine conventionally are supported by tensioning the roof with 4 to 6 foot long steel bolts inserted into bore holes drilled in the mine roof that reinforces the unsupported rock formation above the mine roof. The end of the mine roof bolt may be anchored mechanically to the rock formation by engagement of an expansion assembly on the end of the mine roof bolt with the rock formation. Alternatively, the mine roof bolt may be adhesively bonded to the rock formation with a resin bonding material or a grout inserted or pumped into the bore hole. A combination of mechanical anchoring and resin bonding can also be employed by using both an expansion assembly and resin bonding or grout material.

A mechanically anchored mine roof bolt typically includes an expansion assembly threaded onto one end of the bolt shaft and a drive head for rotating the bolt. A mine roof plate is positioned between the drive head and the mine roof surface. The expansion assembly generally includes a multi-prong shell supported by a threaded ring and a plug threaded onto the end of the bolt. When the prongs of the shell engage with rock surrounding a bore hole, and the bolt is rotated about its longitudinal axis, the plug threads downwardly on the shaft to expand the shell into tight engagement with the rock thereby placing the bolt in tension between the expansion assembly and the mine roof surface.

When resin bonding material is used, it penetrates the surrounding rock formation to unite the rock strata and to firmly hold the roof bolt within the bore hole. Resin is typically inserted into the mine roof bore hole in the form of a two component plastic cartridge having one component containing a curable resin composition and another component containing a curing agent (catalyst). The two component resin cartridge is inserted into the blind end of the bore hole and the mine roof bolt is inserted into the bore hole such that the end of the mine roof bolt ruptures the two component resin cartridge. Upon rotation of the mine roof bolt about its longitudinal axis, the compartments within the resin cartridge are shredded and the components are mixed. The resin mixture fills the annular area between the bore hole wall and the shaft of the mine roof bolt. The mixed resin cures and binds the mine roof bolt to the surrounding rock. Alternatively, the mine roof bolt may be grouted within the bore hole by injecting or pumping grout through the mine roof bolt or through a separate tube into the bore hole. The grout may be a cementitious and/or polyurethane resin grout.

With certain mining conditions, particularly those found in hard rock mining, the rock formation in the ribs and above the mine roof are susceptible to movement or rock bursts as a result of mine-induced seismicity, the excavation of perimeter rock, minor earthquakes, etc. Under dynamic loading caused by rock bursts, mine roof bolts may be vulnerable to failure. Various mine roof bolts have been designed in an effort to better withstand rock bursts. In particular, mine roof bolts have been designed to yield allowing the bolt to absorb some of the dynamic loading caused by a rock burst.

SUMMARY OF THE INVENTION

In one embodiment, a mine bolt includes an elongated body having a first end and a second end positioned opposite the first end, with the elongated body having a first threaded section, a second threaded section, and a smooth, non-threaded section positioned between the first threaded section and the second threaded section. The non-threaded section is configured to yield under loading when the mine bolt is installed with grout in a bore hole.

The elongated body may be a hollow bar defining a central passageway or a bar having a solid core. The first threaded section and the second threaded section may be coarse thread forms. The coarse thread form may be an acme thread. The non-threaded section may be more ductile and yieldable than the first and second threaded sections of the elongated body. The elongated body may be manufactured from a mild steel with the first and second threaded sections being heat treated such that first and second threaded sections are less ductile than the non-threaded section. The elongated body may be manufactured from steel with the non-threaded section being annealed.

The mine bolt may further include a drill bit positioned at the first end of the elongated body. The first threaded section may extend from the first end of the elongated body to a position intermediate the first and second ends of the elongated body, and the second threaded section may extend from the second end of the elongated body to a position intermediate the first and second ends of the elongated body.

In a further aspect, a mine bolt includes an elongated body having a first end and a second end positioned opposite the first end, with the elongated body having a plurality of threaded sections and a plurality of non-threaded sections. Each of the non-threaded sections are positioned between respective threaded sections. The non-threaded sections are configured to yield under loading when the mine bolt is installed with grout in a bore hole.

The first end of the elongated body may have a pointed tip configured to pierce a resin cartridge.

In a further aspect, a method of manufacturing a mine bolt includes threading first and second sections of an elongated body with a non-threaded section positioned between the first and second sections, and heat-treating the elongated body such that the non-threaded section is more ductile and yieldable than the first and second sections.

The heat-treating may include annealing the non-threaded section. The heat-treating may include heat-treating the first and second sections such that the first and second sections are less ductile than the non-threaded section. The elongated body may be a hollow metal bar defining a central passageway. The first and second sections of the elongated body may be threaded with a coarse thread form.

In another aspect, a method of installing a mine bolt includes inserting a mine bolt into a bore hole, with the mine bolt comprising an elongated body having a first end and a second end positioned opposite the first end. The elongated body having a first threaded section, a second threaded section, and a non-threaded section positioned between the first threaded section and the second threaded section. The elongated body is a hollow bar defining a central passageway. The method further includes grouting the mine bolt such that grout is positioned within the central passageway of the elongated body and between the elongated body and rock strata defining the bore hole.

The first and second threaded sections may be rough and configured to engage and bond to the grout, and the non-threaded section may be smooth and configured to de-bond from the ground when the mine roof bolt is placed under loading.

DESCRIPTION OF THE PREFERRED EMBODIMENTS

Figure 1:
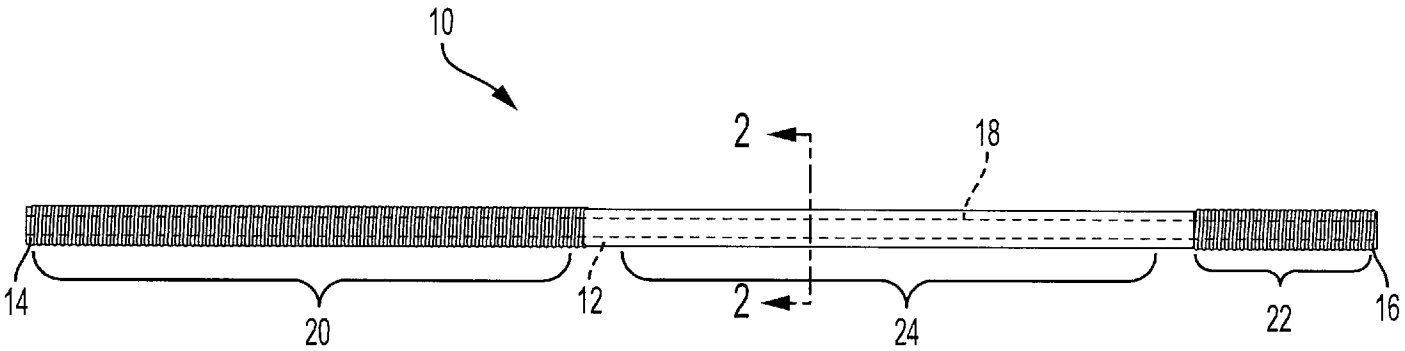
FIG. 1 is a front view of a mine bolt according to one aspect of the present invention.

The present invention will now be described with reference to the accompanying figures. For purposes of the description hereinafter, the terms "upper", "lower", "right", "left", "vertical", "horizontal", "top", "bottom", and derivatives thereof shall relate to the invention as it is oriented in the drawing figures. However, it is to be understood that the invention may assume various alternative variations and step sequences, except where expressly specified to the contrary. It is to be understood that the specific apparatus illustrated in the attached figures and described in the following specification is simply an exemplary embodiment of the present invention. Hence, specific dimensions and other physical characteristics related to the embodiments disclosed herein are not to be considered as limiting.

Figure 2:
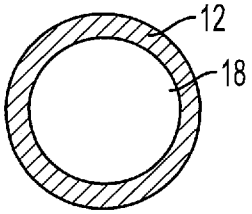
FIG. 2 is a cross-sectional view along line 2-2 shown in FIG. 1.

Referring to FIGS. 1-2, a mine bolt 10, according to one aspect of the present invention, includes an elongated body 12 having a first end 14 and a second end 16 positioned opposite the first end 14. The elongated body 12 is a hollow metal bar that defines a central passageway 18, although other suitable elongated bodies may be utilized. In another aspect, the elongated body 12 may be a solid bar without the central passageway 18. The elongated body 12 has a first threaded section 20, a second threaded section 22, and a non-threaded section 24 positioned between the first threaded section 20 and the second threaded section 22. The first and second threaded sections 20, 22 are rough and configured to engage and bond to grout when the mine bolt 10 is installed in a bore hole. The non-threaded section 24 is a smooth portion of the elongated body 12 and configured to de-bond from grout when the mine bolt 10 is installed in a bore hole. The non-threaded section 24 is configured to yield when the mine bolt 10 is placed under loading, such as dynamic loading or static loading. The first and second threaded sections 20, 22 may be formed as acme threads, although other suitable thread forms may be utilized. In particular, the first and second threaded sections 20, 22 may be coarse threads having any suitable thread form configured to engage grout upon installation of the mine bolt 10 such that the threaded sections 20, 22 anchor the mine bolt 10 within a bore hole. The threaded sections 20, 22 may be a Unified Coarse (UNC) thread form pursuant to the Unified Thread Standard (UTS) as defined by ASME/ANSI B1.1-2003 Unified Inch Screw Threaded (UN & UNR Thread Form). The non-threaded section 24 may be heat-treated such that the non-threaded section 24 is more ductile and yieldable than the first and second threaded sections 20, 22. The heat-treating of the non-threaded section 24 may be provided by an induction heating apparatus (not shown) during manufacture of the mine bolt 10. More specifically, the non-threaded section 24 may be annealed such that the non-threaded section 24 is more ductile and yieldable than the first and second threaded sections 20, 22, although other alternatives may be utilized as discussed below. The non-threaded section 24 may be provided with a de-bonding agent to further assist in de-bonding from the grout to provide yielding during loading of the mine bolt 10.

The first threaded section 20 extends from the first end 14 of the elongated body 12 to a position intermediate the first and second ends 14, 16 of the elongated body 12. The second threaded section 22 extends from the second end 16 of the elongated body 12 to a position intermediate the first and second ends 14, 16 of the elongated body 12. The first threaded section 20 is longer than the second threaded section 22, although other suitable configurations may be utilized. In one aspect, the elongated member 12 is 102 inches long with a 39 inch first threaded section 20, a 39 inch non-threaded section 24, and a 24 inch second threaded section 22. The elongated body 12 may have a minimum yield strength of about 47 kips, a minimum tensile strength of about 58 kips, and a nominal elongation of about 15%, although other suitable properties may be selected.

In one aspect, the mine bolt 10 is manufactured by threading a hollow bar to provide the first and second threaded sections 20, 22 while leaving a portion of the hollow bar unthreaded to form the non-threaded section 24. The non-threaded section 24 of the elongated body 12 is then heat-treated such that the non-threaded section 24 is more ductile and yieldable than the first and second threaded sections 20, 22. The non-threaded section 24 may be heat-threaded through inductive heating with the inductive heating apparatus sufficiently spaced from the first and second threaded sections 20, 22 to ensure the properties of the first and second threaded sections 20, 22 is substantially unchanged by the heat-treatment.

Figure 3:
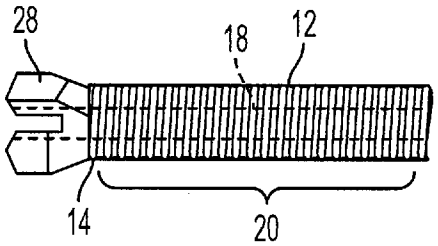
FIG. 3 is a partial front view of a mine bolt according to a further aspect of the present invention.

Referring to FIG. 3, the mine bolt 10 may further include a drill bit 28 secured to the first end 14 of the elongated body 12. With the drill bit 28 attached, the mine bolt 10 forms a self-drilling bolt to allow a bore hole to be drilled using the mine bolt 10 with the mine bolt 10 being subsequently grouted within the bore hole.

Figure 4:
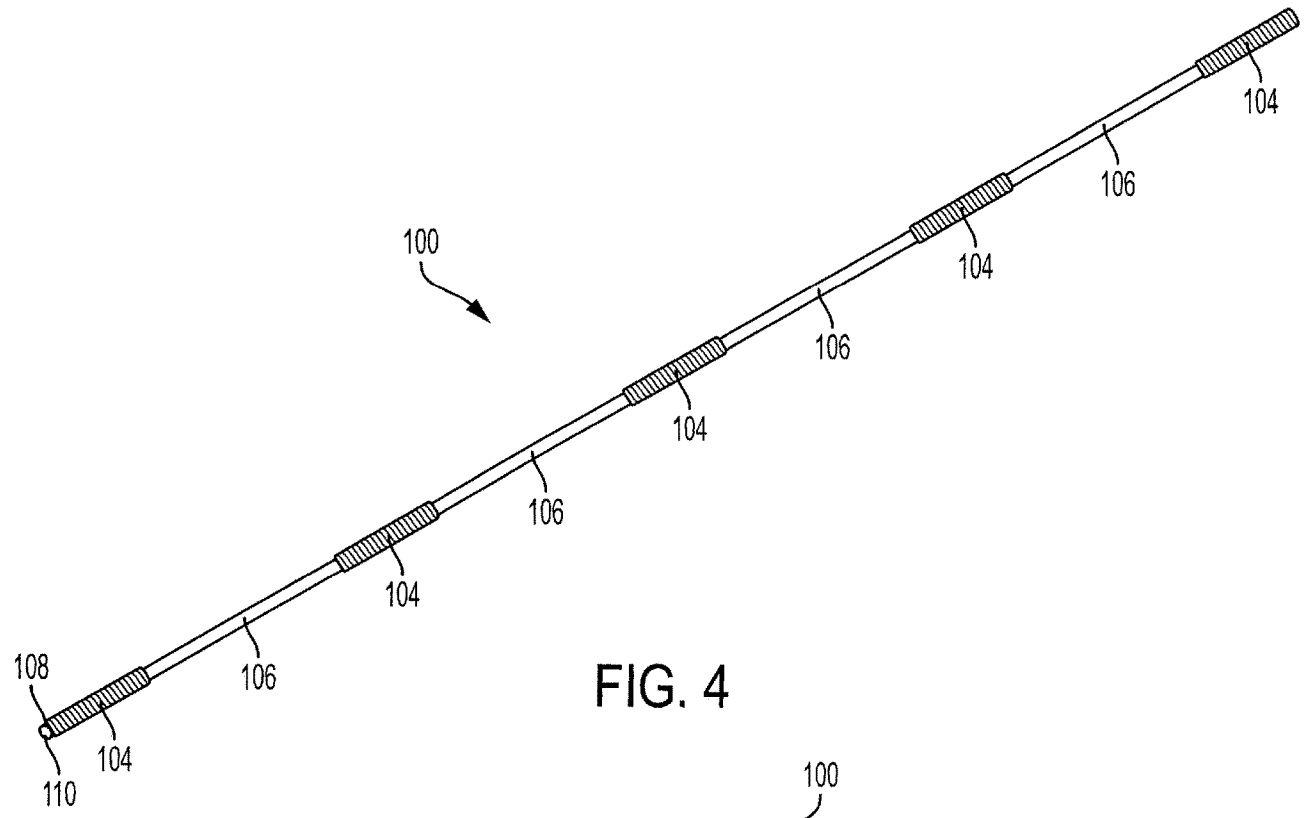
FIG. 4 is a perspective view of a mine bolt according to another aspect of the present invention.
Figure 5:
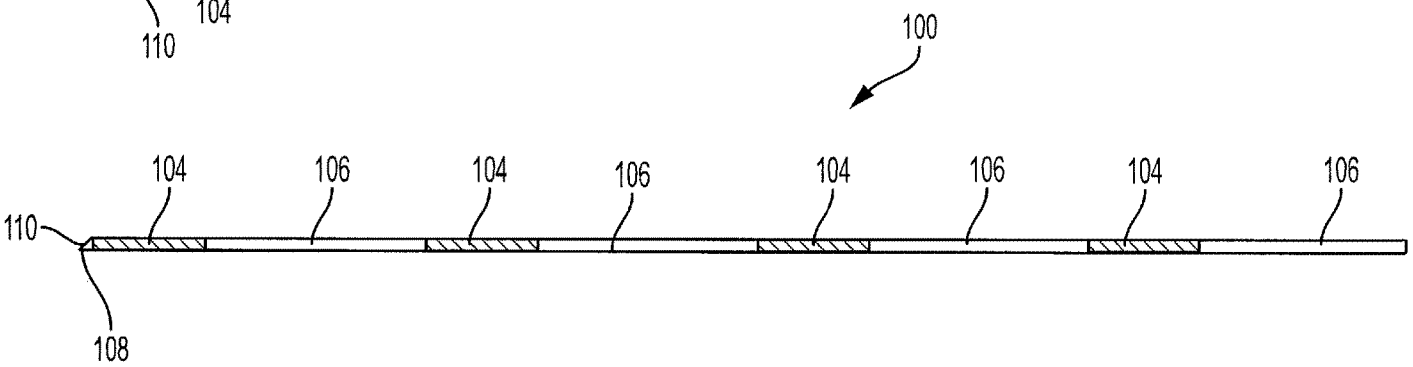
FIG. 5 is a front view of the mine bolt of FIG. 4.

Referring to FIGS. 4 and 5, a mine bolt 100 according to a further aspect of the present invention is shown. The mine bolt 100 is similar to the mine bolt 10 shown in FIGS. 1-3 discussed above. The mine bolt 100, however includes a plurality of threaded sections 104 and non-threaded sections 106. A first end 108 of the mine bolt 100 may include a pointed tip 110 configured to pierce a resin cartridge. The threaded sections 104 may be 6-12 inches and the non-threaded sections 106 may be 12-16 inches. The threaded sections 104 are configured to mix resin and anchor the mine bolt 100 within a bore hole while the non-threaded sections 106 are configured to yield when the mine bolt 100 is installed within a bore hole and subject to loading, such as dynamic loading. For dynamic loading conditions, the length ratio between the threaded sections. 104 and the non-threaded sections 106 may be 6-18 inches. For static loading conditions typically encountered during soft rock mining, the length ratio between the threaded sections 104 and the non-threaded sections 106 may be 10-14 inches.

Figure 6:
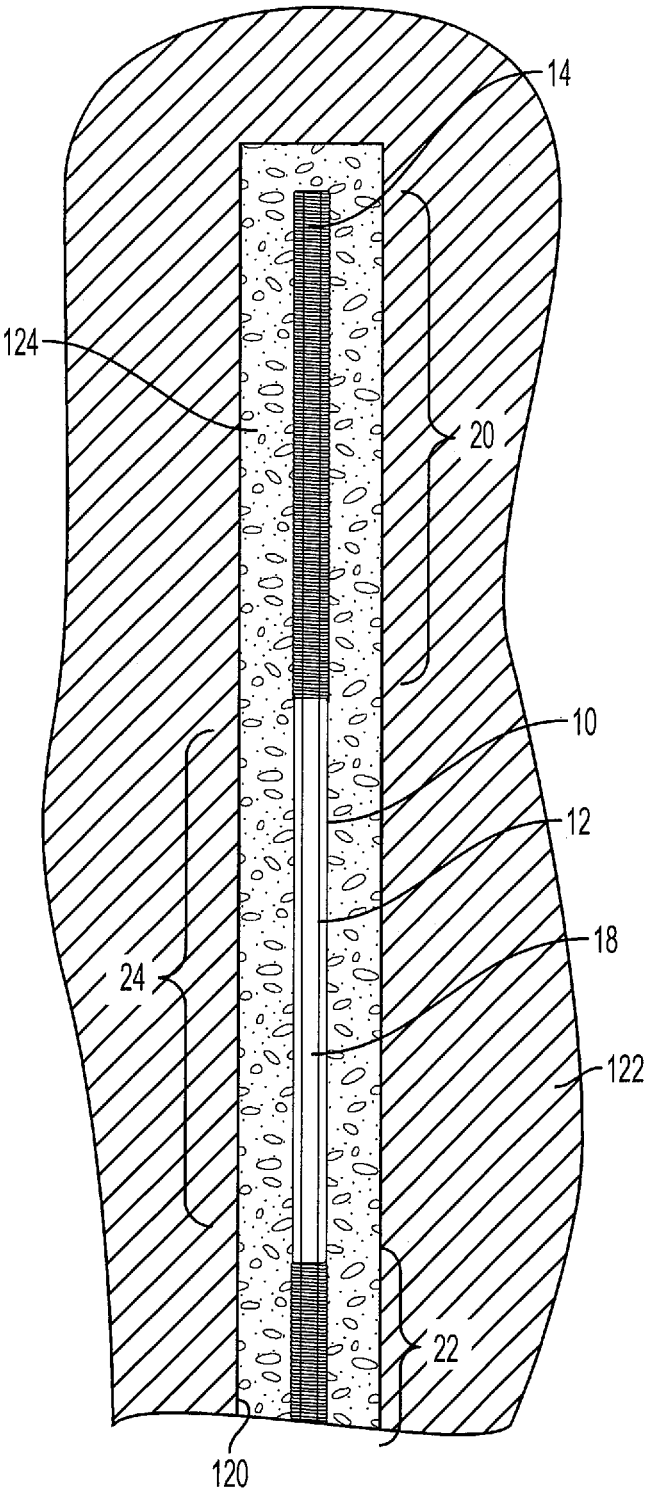
FIG. 6 is a front view of the mine bolt of FIG. 1, showing the mine bolted installed in a bore hole.

Referring to FIG. 6, the mine bolts 10, 100 shown in FIGS. 1-6 may be installed by inserting the mine bolt 10, 100 into a bore hole 120 drilled into rock strata 122. As discussed above in connection with FIG. 3, the bore hole 120 may be drilled with the mine roof bolt 10 itself or with a separate drill steel. The mine bolts 10, 100 are then grouted using a cementitious grout or polyurethane resin grout 124, although other suitable grouts may also be utilized. The grout 124 may be injected or pumped through the central passageway 18 of the elongated body 12. Alternatively, the mine bolts 10, 100 may be grouted using a two-part resin cartridge (not shown) that is inserted into the bore hole 120 prior to inserting the mine bolt 10, 100 with the mine bolt 10, 100 rupturing the cartridge and mixing its contents. The grout 124 is positioned within the central passageway 18 of the elongated body 12 of the mine bolt 10, 100 and between the elongated body 12 and the rock strata 122 defining the bore hole 120 to provide corrosion protection for the mine bolt 10, 100. If the mine bolts 10, 100 utilize an elongated body 12 having a solid core (may be skip rolled), the mine bolts 10, 100 may be post-grouted after installation around the outside of the mine bolts 10, 100.

Figure 7:
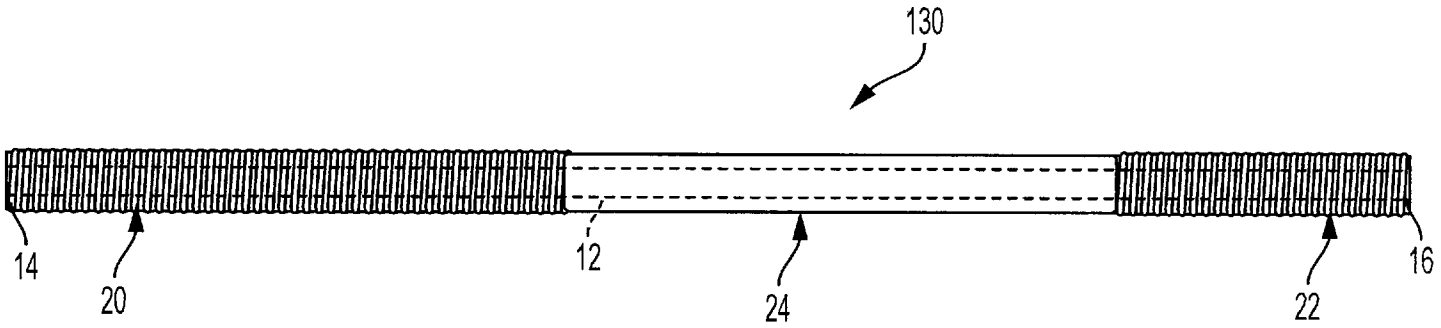
FIG. 7 is a front view of a mine bolt according to yet another aspect of the present invention.
Figure 8:
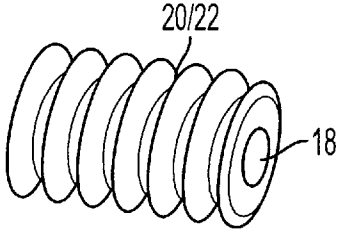
FIG. 8 is an enlarged perspective view of a threaded section of the mine bolt of FIG. 7.

Referring to FIGS. 7 and 8, a mine bolt 130 according to a further aspect of the present invention is shown. The mine bolt 130 is similar to the mine bolt 10 shown in FIGS. 1 and 2 and discussed above. The first and second threaded sections 20, 22, however, are formed from separate tubing sections that are each welded to a separate tubing section that defines the non-threaded section 24. More specifically, the first and second threaded sections 20, 22 may be formed from R32 Steel tube having a tensile strength of 65,000 lbf and an elongation of 10% that are each welded to the non-threaded section 24 made from a section of high elongation steel tubing having a tensile strength of 55,000 lbf and an elongation of 20%, although other suitable materials may be utilized. The first threaded section 20 and the non-threaded section 24 may each be 39 inches and the second threaded section 22 may be 24 inches, although other suitable dimensions may be utilized. Rather than providing separate sections made from different materials, the mine bolt 130 may be made from a single piece of tubing with the non-threaded section 24 being heat-treated or annealed to achieve the same material properties discussed above.

Furthermore, the mine bolt 130 may also be made from a single piece of tubing with the first and second threaded sections 20, 22 heat-treated to have a higher strength and corresponding lower elongation and ductility compared to the non-threaded section 24. The single piece of tubing may be made from a mild steel having the desired strength and ductility properties for the non-threaded section 24 with the first and second threaded sections 20, 22 being heat-treated to increase the strength and reduce the ductility. The non-threaded section 24 of the mine bolt 130 may also have a reduced cross-sectional area relative to the threaded sections 20, 22. The non-threaded section 24 of the mine bolt 130 may have an outer diameter that is smaller than the major diameter of the threads of the threaded sections 20, 22, although the non-threaded section 24 may also have a smaller outer diameter than the pitch diameter and/or minimum diameter of the threads of the threaded sections 20, 22. The non-threaded section 24 of the mine bolt 130 may be a tube with a smaller cross-sectional area relative to the threaded sections 20, 22 or may be machined, rolled, or otherwise processed via metalworking to reduce the cross-sectional area of the non-threaded section 24.

Figure 9:
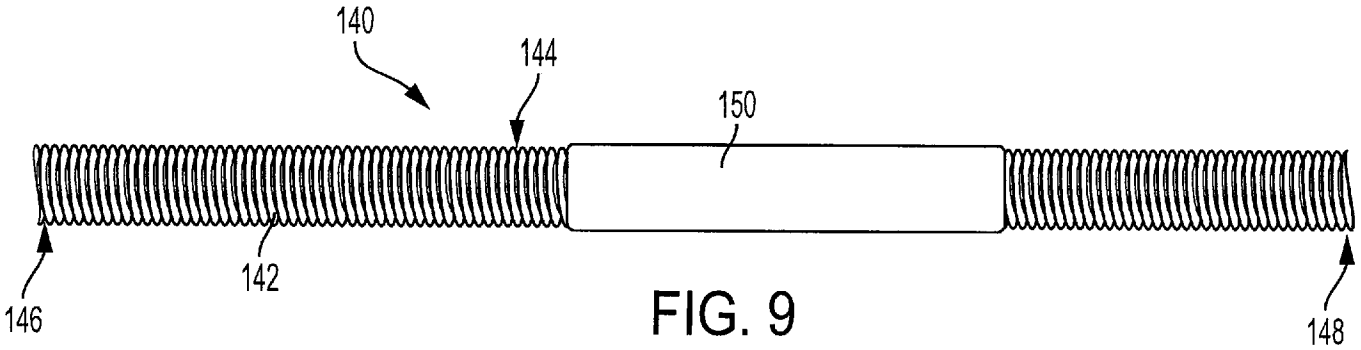
FIG. 9 is a front view of a mine bolt according to a further aspect of the present invention.
Figure 10:
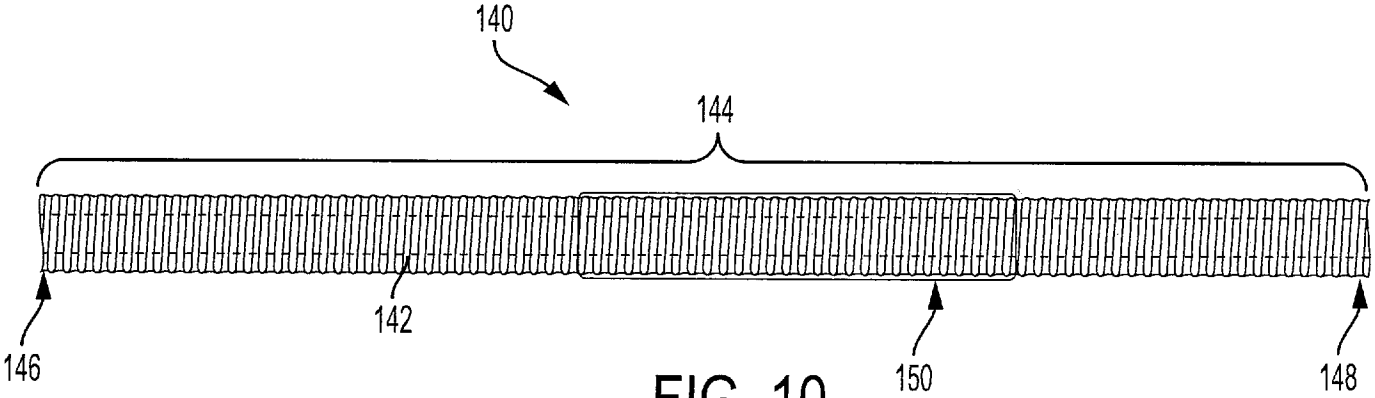
FIG. 10 is a partial cross-sectional view of the mine bolt of FIG. 9.

Referring to FIGS. 9 and 10, a mine bolt 140 according to a further aspect of the present invention is shown. The mine bolt 140 is similar to the mine bolt 10 shown in FIGS. 1 and 2 and discussed above. However, rather than providing the first and second threaded sections 20, 22 and the non-threaded section 24, an elongated body 142 is provided with a threaded section 144 that extends from a first end 146 to a second end 148 of the elongated body 142. The mine bolt 140 further includes a de-bonding pipe 150 positioned over the elongated body 142. An intermediate section of the mine bolt 140 having the de-bonding pipe 150 functions in a similar manner as the non-threaded section 24 discussed above in connection with the mine bolt 10 shown in FIGS. 1 and 2. In particular, the de-bonding pipe 150 is configured to de-bond from grout upon installation of the mine bolt 140 to allow the intermediate section of the mine bolt 140 to yielding during dynamic or static loading of the bolt mine 140. The position of the de-bonding pipe 150 along the elongated body 142 may be fixed via crimping or a friction fit, although other suitable arrangements may be utilized. The intermediate section of the mine bolt 140 between the first and second ends 146, 148 is more ductile and yieldable compared to the sections adjacent to the de-bonding pipe 150. The intermediate section of the elongated body 142 with the de-bonding pipe 150 may be annealed to provide the higher ductility. Alternatively, the sections between the first and second ends 146, 148 and de-bonding pipe 150 may be heat-treated to increase the strength of such sections while leaving the intermediate section of the elongate body 142 having a higher ductility and lower strength. The de-bonding pipe 150 may be manufactured from a polymer, such as nylon, although other suitable materials and polymers may be utilized.

While several embodiments were described in the foregoing detailed description, those skilled in the art may make modifications and alterations to these embodiments without departing from the scope and spirit of the invention. Accordingly, the foregoing description is intended to be illustrative rather than restrictive.

The invention claimed is:

1. A mine bolt comprising:

an elongated body having a first end and a second end positioned opposite the first end, the elongated body having a first threaded section, a second threaded section, and a smooth, non-threaded section positioned between the first threaded section and the second threaded section, wherein the non-threaded section is configured to yield under loading when the mine bolt is installed with grout in a bore hole, wherein a material of the non-threaded section is more ductile and yieldable than a material of the first and second threaded sections of the elongated body, wherein the elongated body comprises a hollow bar defining a central passageway extending from the first end of the elongated body to the second end of the elongated body, wherein the central passageway is configured to convey the grout to the bore hole, wherein the first and second threaded sections of the elongated body are configured to engage and bond to the grout when the mine bolt is installed in the bore hole, wherein the first threaded section extends from the first end of the elongated body to the smooth, non-threaded section, wherein the second threaded section extends from the second end of the elongated body to the smooth, non-threaded section and wherein the non-threaded section of the elongated body is straight.

2. The mine bolt of claim 1, wherein the smooth, non-threaded section is welded to the first and second threaded sections.

3. The mine bolt of claim 1, wherein the first threaded section and the second threaded section each comprise a coarse thread form.

4. The mine bolt of claim 3, wherein the first threaded section and the second threaded section each comprise an acme thread.

5. The mine bolt of claim 1, wherein the elongated body is manufactured from a mild steel with the first and second threaded sections being heat-treated such that the first and second threaded sections are less ductile than the non-threaded section.

6. The mine bolt of claim 1, further comprising a drill bit positioned at the first end of the elongated body.

7. The mine bolt of claim 1, wherein the material of the non-threaded section comprises an annealed steel.

8. The mine bolt of claim 7, wherein the material of the first and second threaded sections of the elongated body comprises a non-annealed steel.

9. The mine bolt of claim 1, wherein the elongated body extends continuously from the first end to the second end.

* * * * *